US012071737B2

(12) United States Patent
Jalla

(10) Patent No.: US 12,071,737 B2
(45) Date of Patent: Aug. 27, 2024

(54) FOUNDATION WALL SYSTEM

(71) Applicant: Consulting Engineers, Corp., Reston, VA (US)

(72) Inventor: Maharaj Jalla, Great Falls, VA (US)

( * ) Notice: Subject to any disclaimer, the term of this patent is extended or adjusted under 35 U.S.C. 154(b) by 0 days.

(21) Appl. No.: 17/008,806

(22) Filed: Sep. 1, 2020

(65) Prior Publication Data

US 2022/0064894 A1 Mar. 3, 2022

(51) Int. Cl.
*E02D 27/08* (2006.01)
*E04B 2/64* (2006.01)

(52) U.S. Cl.
CPC ..... *E02D 27/08* (2013.01); *E04B 2/64* (2013.01); *E02D 2250/0023* (2013.01)

(58) Field of Classification Search
CPC .... E02D 27/08; E02D 2250/0023; E04B 2/64
See application file for complete search history.

(56) References Cited

U.S. PATENT DOCUMENTS 1,356,319 A * 10/1920 Smulski ..... E02D 29/0266 52/234
4,000,622 A * 1/1977 Chiaves ..... E02D 29/0266 52/169.1
4,251,971 A * 2/1981 Unthank ..... E01C 11/18 52/684
4,463,529 A * 8/1984 Singer ..... E02D 31/02 405/229
4,572,711 A * 2/1986 Benson ..... E02D 29/0266 52/223.4
5,468,098 A * 11/1995 Babcock ..... E02D 29/0225 405/262
7,828,497 B2 * 11/2010 Boxberger ..... E02D 29/02 405/286
7,896,582 B2 * 3/2011 Chouery ..... E02D 29/02 405/262
8,607,525 B2 * 12/2013 Trotter ..... E04B 1/7023 52/302.6
9,758,944 B2 * 9/2017 Parks ..... E02D 31/025
10,267,011 B2 * 4/2019 Baumgartner ..... E02D 29/0266
2014/0270990 A1 * 9/2014 Heraty ..... E02D 29/0266 405/286

FOREIGN PATENT DOCUMENTS

KR 100799358 B1 * 4/2007

* cited by examiner

*Primary Examiner* — Brian D Mattei
*Assistant Examiner* — Omar F Hijaz
(74) *Attorney, Agent, or Firm* — Andrew Morabito

(57) ABSTRACT

The invention relates to foundation wall system comprising: a foundation wall of a known height, thickness, and length; a plurality of lateral stiffeners structures integrated into the foundation wall at predetermined location along the length of the foundation wall.

4 Claims, 12 Drawing Sheets

FOUNDATION WALL SYSTEM

BACKGROUND

This disclosure relates generally to building construction and in particular, to the method, computer program, or computer system for construction of foundation walls system that eliminates the need to construct a first floor deck and extra beams to carry and transfer the load before backfilling of soil.

Typical construction of the building is done in various steps, excavation, foundation construction, floor construction, wall construction and finally roof construction. In load bearing building construction, foundation of wall is main part to transfer the total load to foundation below. Care should be taken while its construction. In other type of building construction which is framed construction, after the construction of foundation and plinth level, construction of concrete floor has to be followed to construct upper floors. Also for construction of walls we required beams below it to take the load of the wall and for this we have to first excavate whole soil present there to construct foundation and floor, after that we have to backfill again. Both these processes consume large amount resource like materials and manpower as well as time.

If the basement or foundation wall is rigid and does not move, then the pressure exerted on the wall is in a state of elastic equilibrium. However, this is unlikely the case and the foundation wall will defect due to the pressure applied by the backfilled soil. This requires additional components to attempt to reach the elastic equilibrium.

In the current practice for construction of concrete foundation walls, Building Codes require that backfilling of soil against a foundation wall must be delayed until after the foundation wall is anchored to a subsequently constructed first floor deck. That creates a difficult task of moving construction personnel and materials for building the first floor deck support structure across a seven or eight feet deep trench.

The primary object of the present invention is to provide an alternative foundation wall design based on a more practical procedure for analyzing, planning and constructing foundation walls, which is sound from an engineering point of view, economical and time-efficient. This foundation wall system allows backfilling of soil before the construction of the first floor deck.

SUMMARY

In a first embodiment, the present invention is a foundation wall system comprising: a foundation wall of a known height, thickness, and length; a plurality of lateral stiffeners structures integrated into the foundation wall at predetermined location along the length of the foundation wall.

In a second embodiment, the present invention is a method of constructing a foundation wall, comprising: identifying a height and a length of a foundation wall member and calculating a load applied to the foundation wall member based on a backfill soil depth, backfill soil type, and grade height from a base of the foundation wall member, wherein the calculated applied load is above a threshold value, integrating at least one lateral stiffener into the foundation wall member, wherein the position of the lateral stiffener creates segments of the foundation wall member and recalculating the applied load across each of the segments of the foundation wall member and determining if the applied load is above the threshold value.

In a third embodiment, the present invention is a method of forming a foundation, the method comprising: Said foundation wall and said lateral stiffening structure being poured monolithically; and Said foundation wall being subdivided into segments by said lateral stiffening structures, so as to ensure that each said segment has two vertical edges and two horizontal edges in elevation view.

BRIEF DESCRIPTION OF THE DRAWINGS

The present invention will be more readily understood by reference to the following description when read in conjunction with the attached drawings.

DETAILED DESCRIPTION

Figure 1:
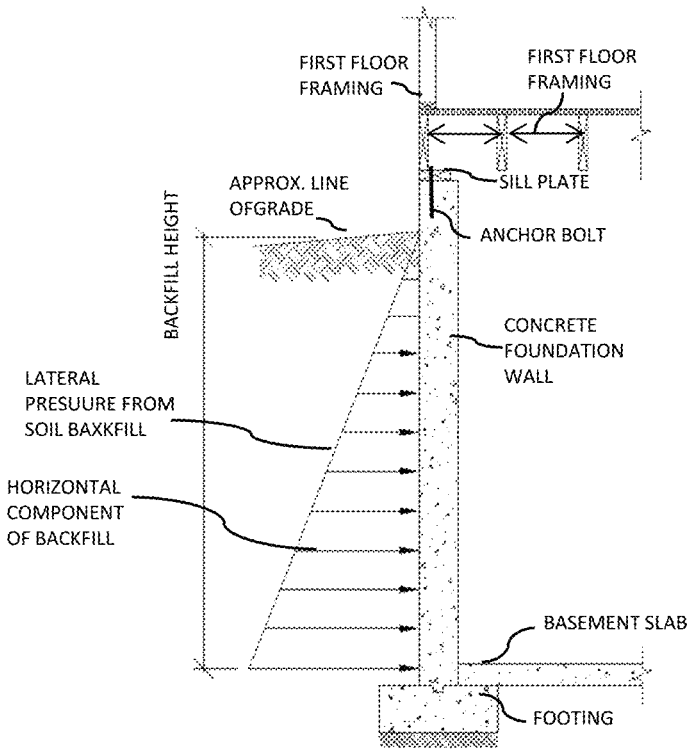
FIG. 1 depicts an illustration of the forces exerted on a concrete foundation wall, in accordance with one embodiment of the present invention.
Figure 2:
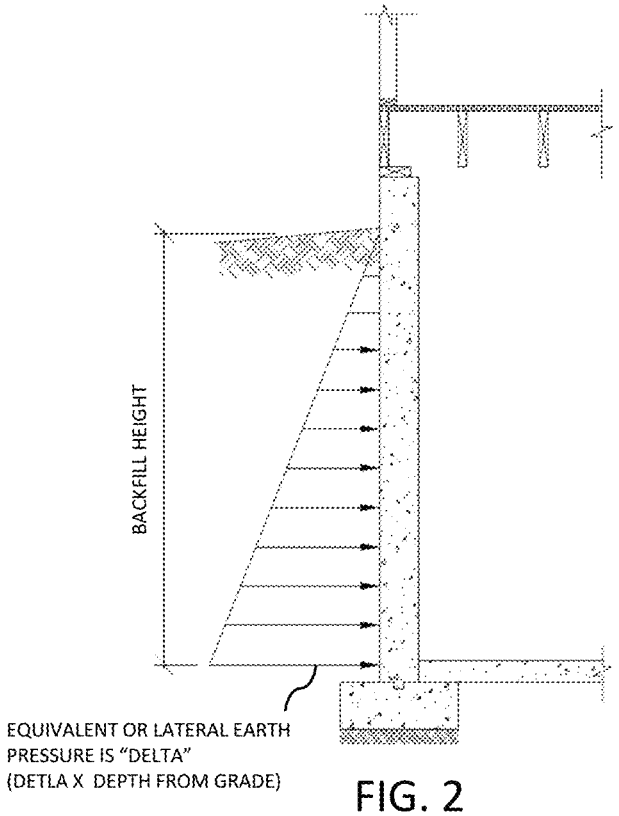
FIG. 2 depicts an illustration of the forces exerted on a concrete foundation wall, in accordance with one embodiment of the present invention.

The present invention generally relates the process of construction of the walls of a foundation. By using this technique of wall foundation construction, the foundation of a building can be built in less time, require less material, and provide equal or greater strength than currently design foundation walls. In many situations, the foundation design explained provides more stabilization in case of rotation and sliding. FIGS. 1 and 2 depict illustrations of the load applied on a foundation (basement) wall due to backfill soil (e.g. footer or foundation). The grade line is shown with the load the soil applies to the foundation wall increasing as the dept of the soil increases. The foundation wall is shown to consist of a footing, foundation slab, foundation wall, with the building (e.g. sill plate, anchor bolt, and first floor framing materials). This is a typical loading applied to the foundation wall. Soil load increases as the depth of soil increases.

The present invention relates to a foundation wall system for residential houses that eliminates the need to construct a first floor deck and beams to carry and transfer the load before backfilling of soil. This requires less work related to the excavation and back filling and also help in maintaining stability after backfilling of soil.

From an engineering point of view, if we design foundation wall as a one-way distribution the quantity of material requirement is greater. The present invention use of lateral stiffener are added to a wall, which helps in breaking the span of the wall and convert it in small span and also acts as a support to it. The lateral stiffeners also reduce if not eliminate and deflect or movement of the wall, and thus reduce the overall forces applied to the wall. The final load distribution is in two-way direction and thus requires less quantity of material. The invented process provides the advantage of increasing the speed of construction by allowing the backfilling of soil before the floor deck is constructed.

Figure 3:
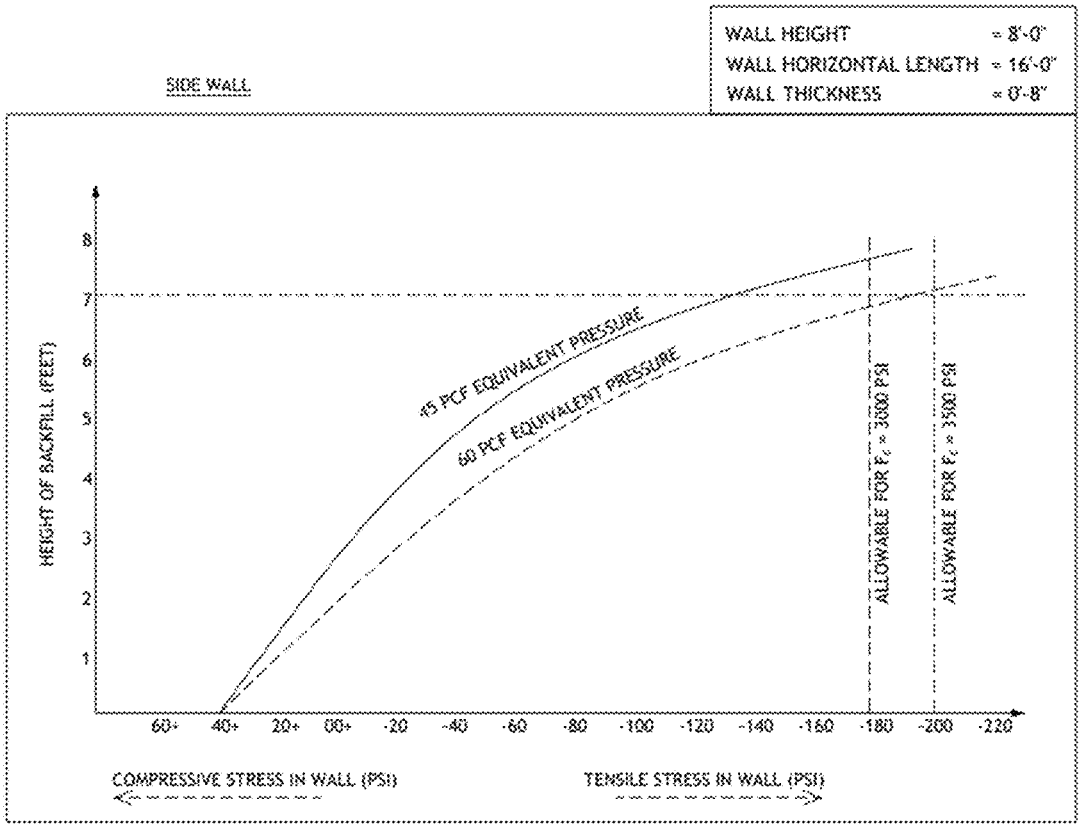
FIG. 3 depicts a graphical representation of compression stresses and tensile stresses in a wall, in accordance with one embodiment of the present invention.
Figure 4:
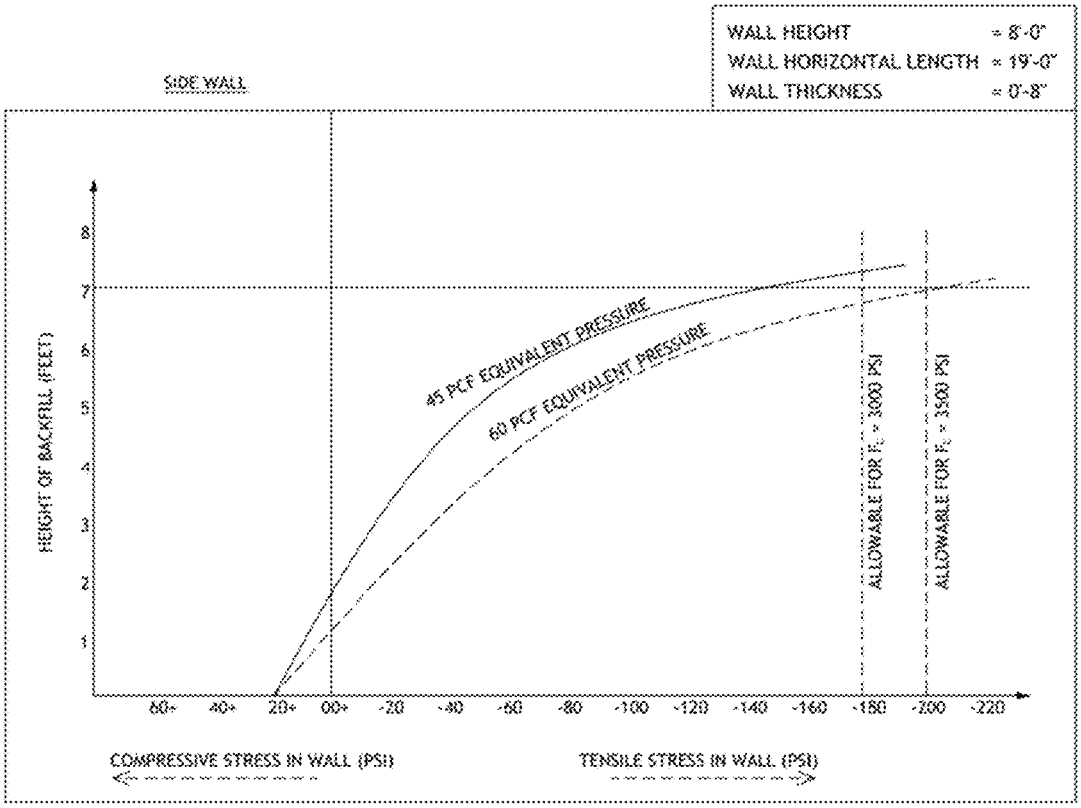
FIG. 4 depicts a graphical representation of compression stresses and tensile stresses in a wall, in accordance with one embodiment of the present invention.
Figure 5:
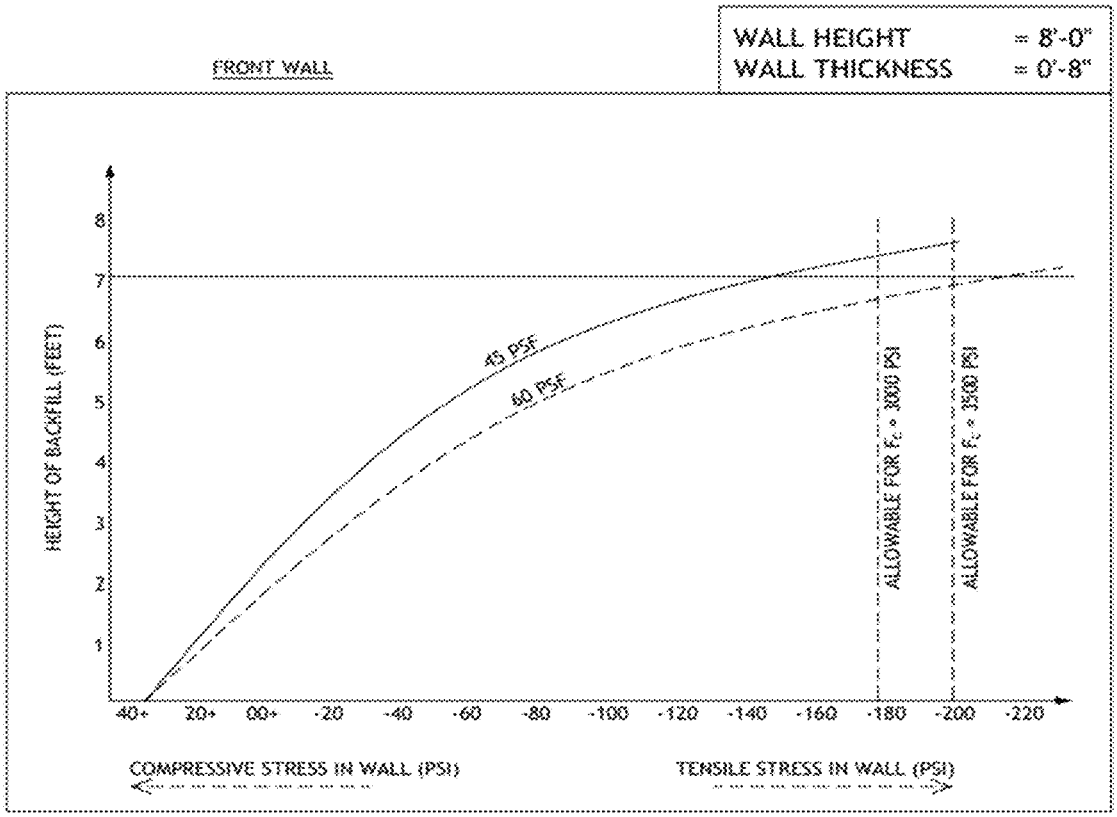
FIG. 5 depicts a graphical representation of compression stresses and tensile stresses in a wall, in accordance with one embodiment of the present invention.
Figure 6:
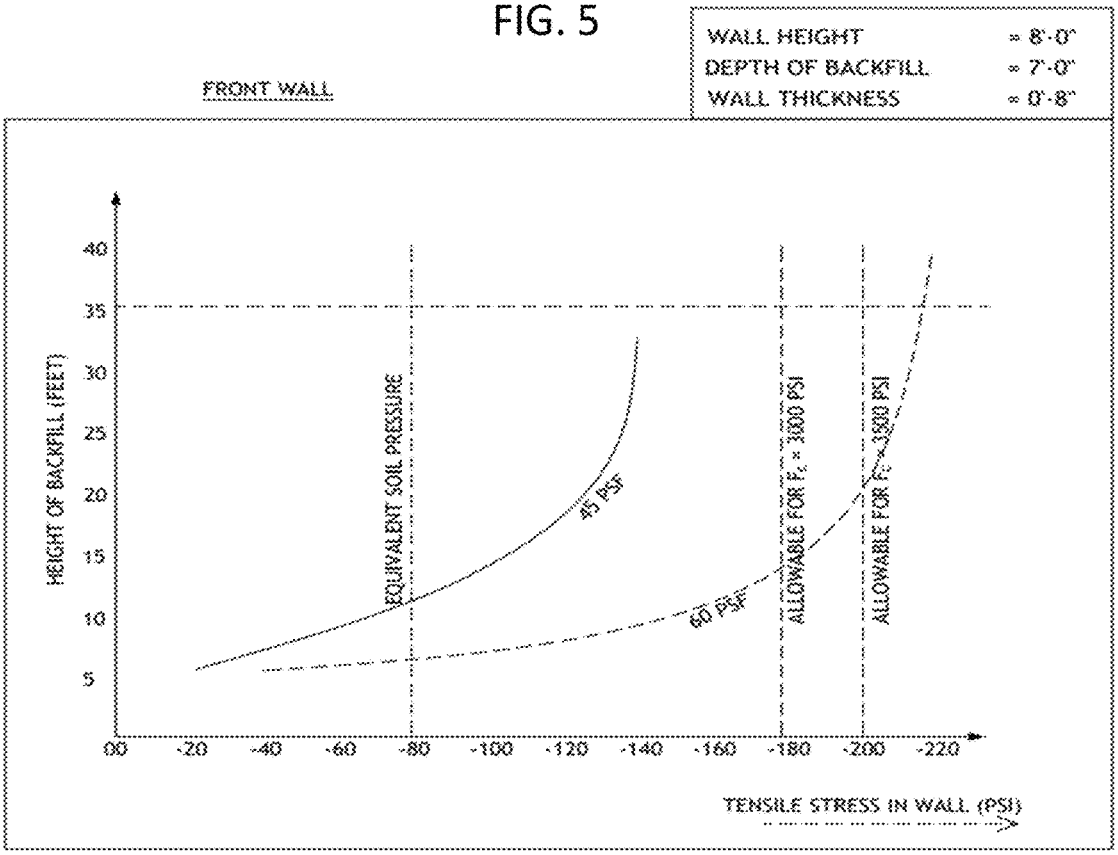
FIG. 6 depicts a graphical representation of compression stresses and tensile stresses in a wall, in accordance with one embodiment of the present invention.
Figure 7:
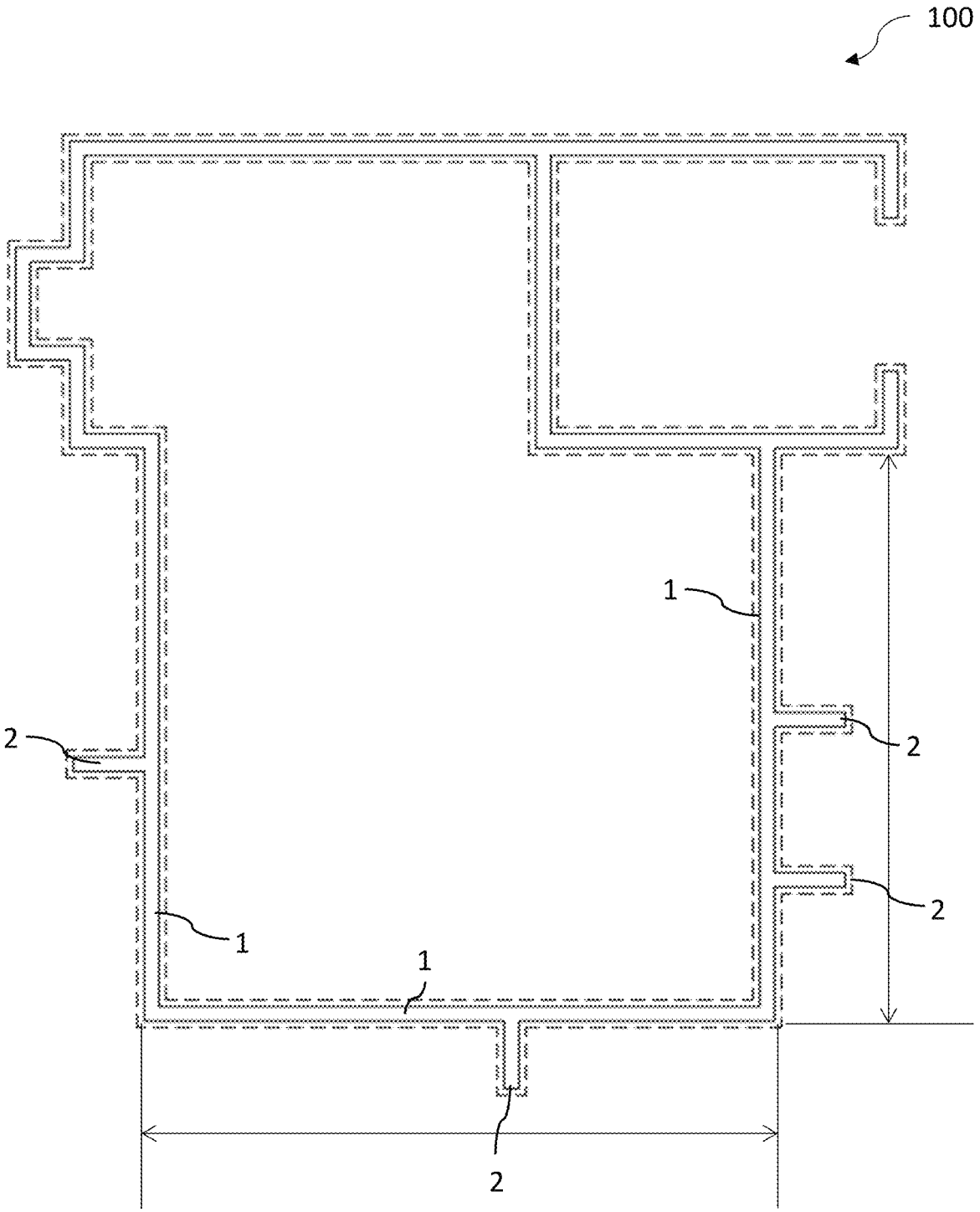
FIG. 7 depicts a top view of a foundation wall system, in accordance with one embodiment of the present invention.

FIGS. 3-5 depict graphical representations of the stresses of the soil on foundation walls based on the height and location of the foundation wall. The stresses are shown as compression stress and tensile stress based on the equivalent pressure. The stress distribution of a foundation wall as per current construction practice which is a one-way load distribution. The stress distribution of foundation wall as per the proposed invention with the addition of the lateral stiffener and modifying the load distribution to a two-way approach is shown in FIG. 7.

The present invention uses the unique feature of the foundation wall supported by incorporating extra lateral stiffeners. These lateral stiffeners act as an extra support and help to restrained against the rotation due to its own weight and the soil supported by these lateral stiffeners. The additional of these lateral stiffeners provides the advantage of reducing the overall quantity of material necessary to build the foundation wall, while maintaining the desired or minimum structural requirements. This is advantageous to create foundations for buildings that are stronger and require less material. The lateral stiffeners act as support and also break the long span of the foundation wall thereby reducing the overall stress on the foundation wall by using two-way load distribution approach and providing additional strength to the foundation wall.

In the present design the lateral stiffeners are acting as a Deadman force to pull the foundation wall towards the backfill which provides a force reduction over the net forces exerted on the wall, as a result. A concrete wall has limited tensile strength, compression strength, thus reducing these stresses is needed or the reinforcement of the wall is necessary. Typically the reinforcement of the wall results in additional materials needed and work required resulting in an increase in price. The redesign of the wall to reduce the tensile and compression forces on the wall is a more efficient and effective way to correct this problem.

As will be apparent to those of skill in the art upon reading this disclosure, each of the individual embodiments described and illustrated herein has discrete components and features which may be readily separated from or combined with the features of any of the other several embodiments without departing from the scope or spirit of the present invention. It is to be understood that this invention is not limited to particular embodiments described, as such may, of course, vary. It is also to be understood that the terminology used herein is for the purpose of describing particular embodiments only, and is not intended to be limiting, since the scope of the present invention will be limited only by the appended claims.

Unless defined otherwise, all technical and scientific terms used herein have the same meaning as commonly understood by one of ordinary skill in the art to which this invention belongs. Although any methods and materials similar or equivalent to those described herein can also be used in the practice or testing of the present invention, the preferred methods and materials are now described.

All publications and patents cited in this specification are herein incorporated by reference as if each individual publication or patent were specifically and individually indicated to be incorporated by reference and are incorporated herein by reference to disclose and describe the methods and/or materials in connection with which the publications are cited. The citation of any publication is for its disclosure prior to the filing date and should not be construed as an admission that the present invention is not entitled to antedate such publication by virtue of prior invention. Further, the dates of publication provided may be different from the actual publication dates which may need to be independently confirmed.

It must be noted that as used herein and in the appended claims, the singular forms "a", "an", and "the" include plural referents unless the context clearly dictates otherwise. It is further noted that the claims may be drafted to exclude any optional element. As such, this statement is intended to serve as antecedent basis for use of such exclusive terminology as "solely," "only" and the like in connection with the recitation of claim elements, or use of a "negative" limitation.

In FIGS. 7-13 depict various images of house (e.g. building, structure, or the like) foundation structure 100. This house foundation structure 100 is comprised of concrete foundation walls 1, lateral stiffeners 2, first floor deck construction (in interrupted lines) 4, and foundation footing 5. The ground level 3 is also shown to illustrate the height of the foundation walls 1 and the lateral stiffeners 2. In the depicted embodiment, the foundation walls 1 are of varying lengths based on the building design and structure. In the depicted embodiment, the foundation walls 1 have all substantially the same height, but in additional embodiments the height of the foundation walls 1 may vary.

The foundation walls 1 in the depicted embodiment are constructed from poured concrete. The lateral stiffeners 2 are also poured concrete. In the depicted embodiment, the height of the lateral stiffeners 2 is smaller than the height of wall foundation 1 and it should be below the grade level 3 and thus it will not interfere in architectural properties of the building. The positioning of the lateral stiffeners 2 is based on the span of the foundation walls 1 which the lateral stiffeners 2 are integrated into. In the depicted embodiment, specific foundation walls 1 have one or more lateral stiffeners 2 and are positioned at predetermined locations along the foundation walls 1. The length of the foundation wall 1 dictates the number and placement of the lateral stiffeners 2, as well as the size of the lateral stiffeners 2. In additional embodiments the location, size, and shape of the lateral stiffeners can be calculated and identified by various types of computing systems, such as, but not limited to, machine learning, artificial intelligence, and the like. Additionally, software can be created to calculate the size of each wall member, the load applied to the wall member, and calculate an approximate location for the lateral stiffeners to reduce the load over the wall member to below a predetermined threshold value Foundation walls 1 have to resist lateral pressure 11 from soil backfill and vertical load from the structure grade level. When the gravity loads acts on the structure it will transferred to the soil through foundation, but the soil also acts lateral pressure on the foundation wall 1 and this pressure is acting below the grade level. The vertical loads will be transferred to the foundation through floor joists 4 resting on the wall foundation surface. As shown in FIG. 7 the pressure 11 forces begin at the soil level 3 and increase as the foundation wall 1 extending into the soil, until meeting the base 5. The lateral stiffener 2 creates a termination of the force 11 against the foundation wall 1. The soil level 3 is lower than the total height 8A of the foundation walls 1. The grade level height 7 is comparable to the soil level 3. The length of a predetermined segment of the foundation wall 10 has a graduated lateral load 11 on the foundation wall 1.

In the existing practice, with the upper end of a horizontally elongated concrete foundation wall supported against lateral movement by a first floor structure, the wall acts as a vertically oriented beam. As a result, with backfilling of soil, maximum bending moment gets induced in the middle portion of the foundation wall along its height. This bending moment places the inner surface of the foundation wall under tensile stress.

The equivalent fluid weight of unsupported backfill using normal "good" soils is about forty five pounds per cubic foot (45 pcf). For such soils, the codes of the American Concrete Institute (ACI) and American Society of civil Engineers (ASCE) permit an eight feet high foundation wall constructed with eight inches thick, plain concrete, for the purpose of withstanding seven feet high backfill, provided that the first floor construction is carried out before the placement of backfill. With "problem" soils, the backfill could exert an equivalent fluid weight as high as 60 pcf, and for such soils, the existing practice requires thicker foundation walls 1 and/or use of steel rods as reinforcement. The first floor structure 4, shown in FIGS. 1 and 2, provides shear resistance against the laterally directed load exerted by the soil backfill. The shear resistance is provided by anchor bolts passing through a sill plate placed at the top of the foundation wall. Generally, these anchor bolts are ⅝" or ½" diameter and are provided at a spacing of 6 to 8 feet.

Figure 8:
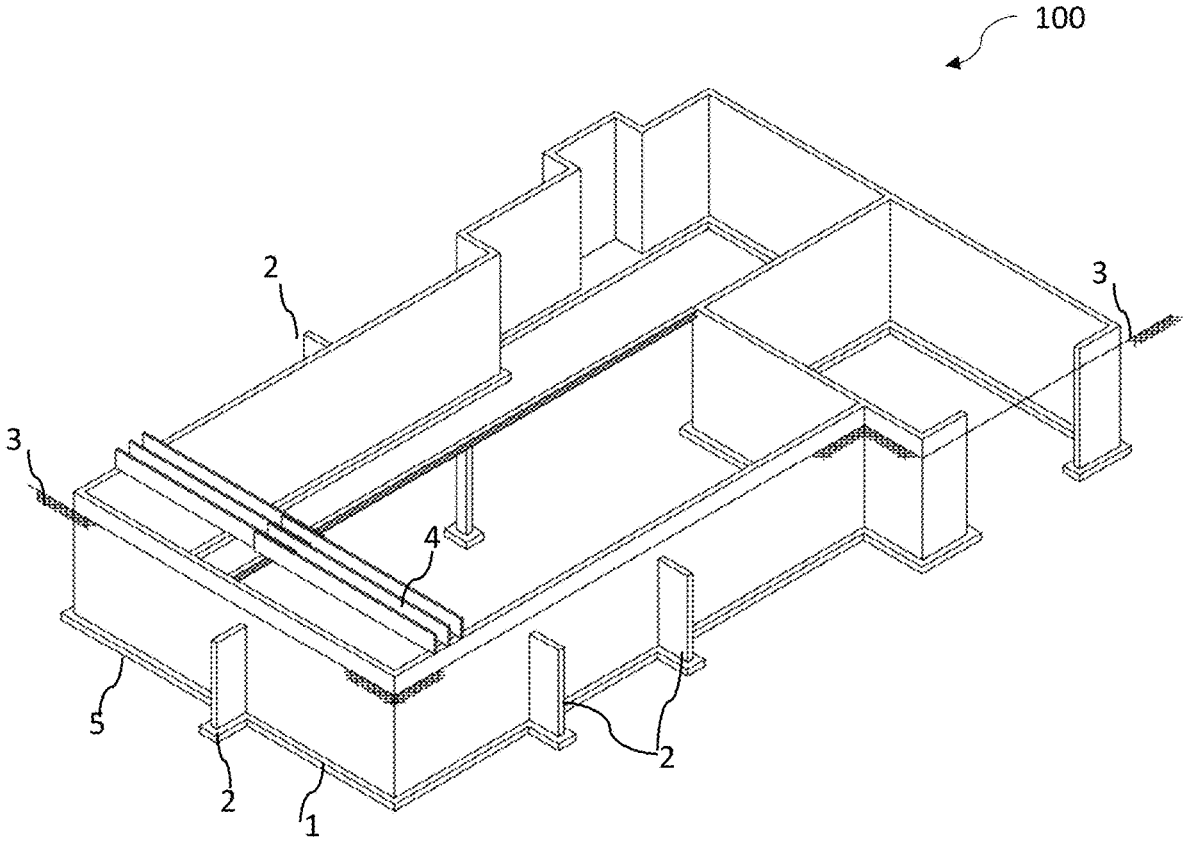
FIG. 8 depicts an isometric view of a concrete foundation with lateral stiffeners, in accordance an embodiment of the present invention.

The present invention provides an alternative procedure. In this procedure, resistance against backfill load is provided by lateral stiffening structures also known as lateral stiffeners. The horizontally elongated foundation wall is subdivided into predetermined lengths and lateral stiffeners 2 as shown in FIG. 8 are constructed monolithically with the foundation wall at the dividing locations.

Figure 9:
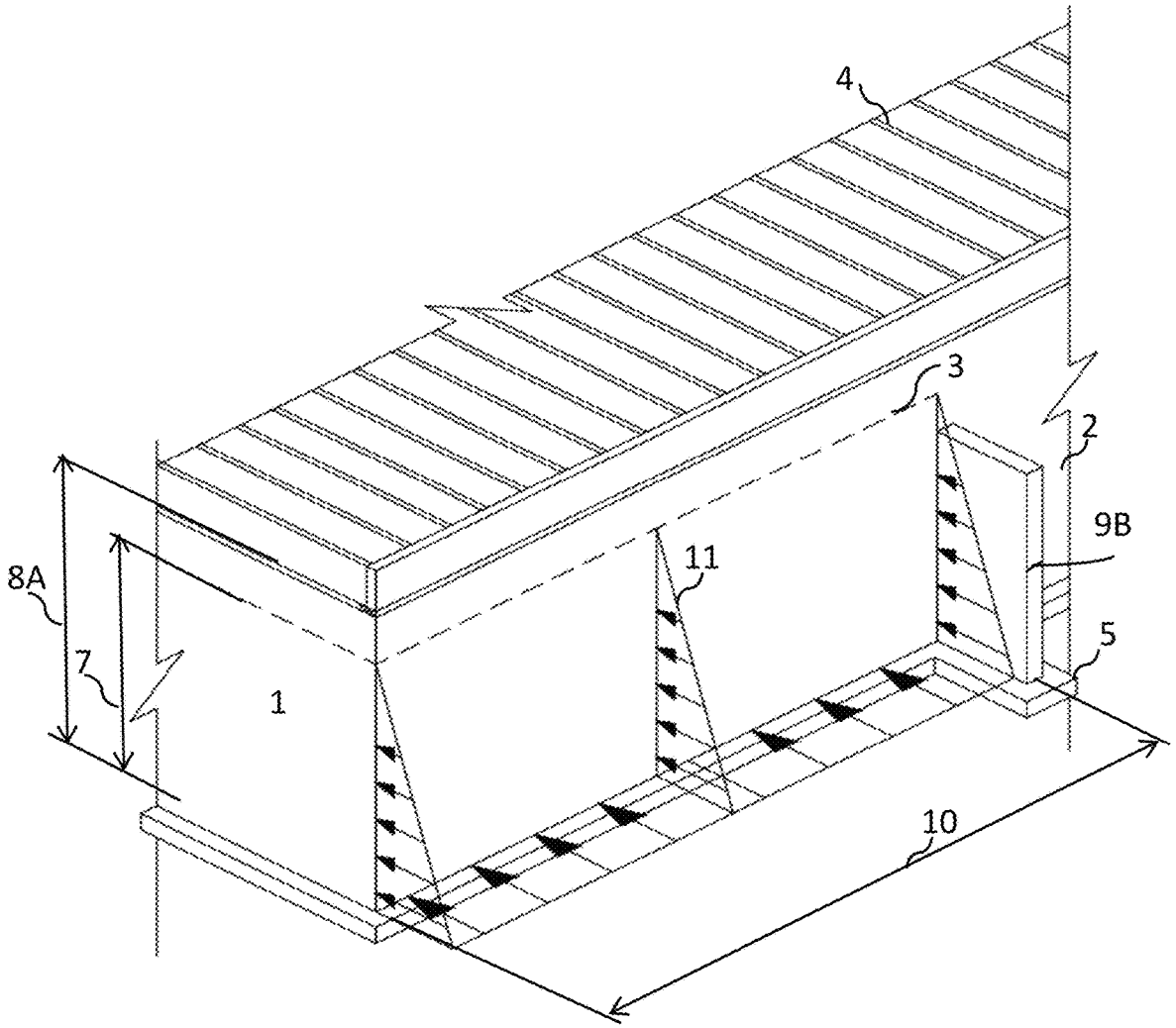
FIG. 9 depicts an isometric view of a concrete foundation section with lateral stiffeners, in accordance an embodiment of the present invention.
Figure 10:
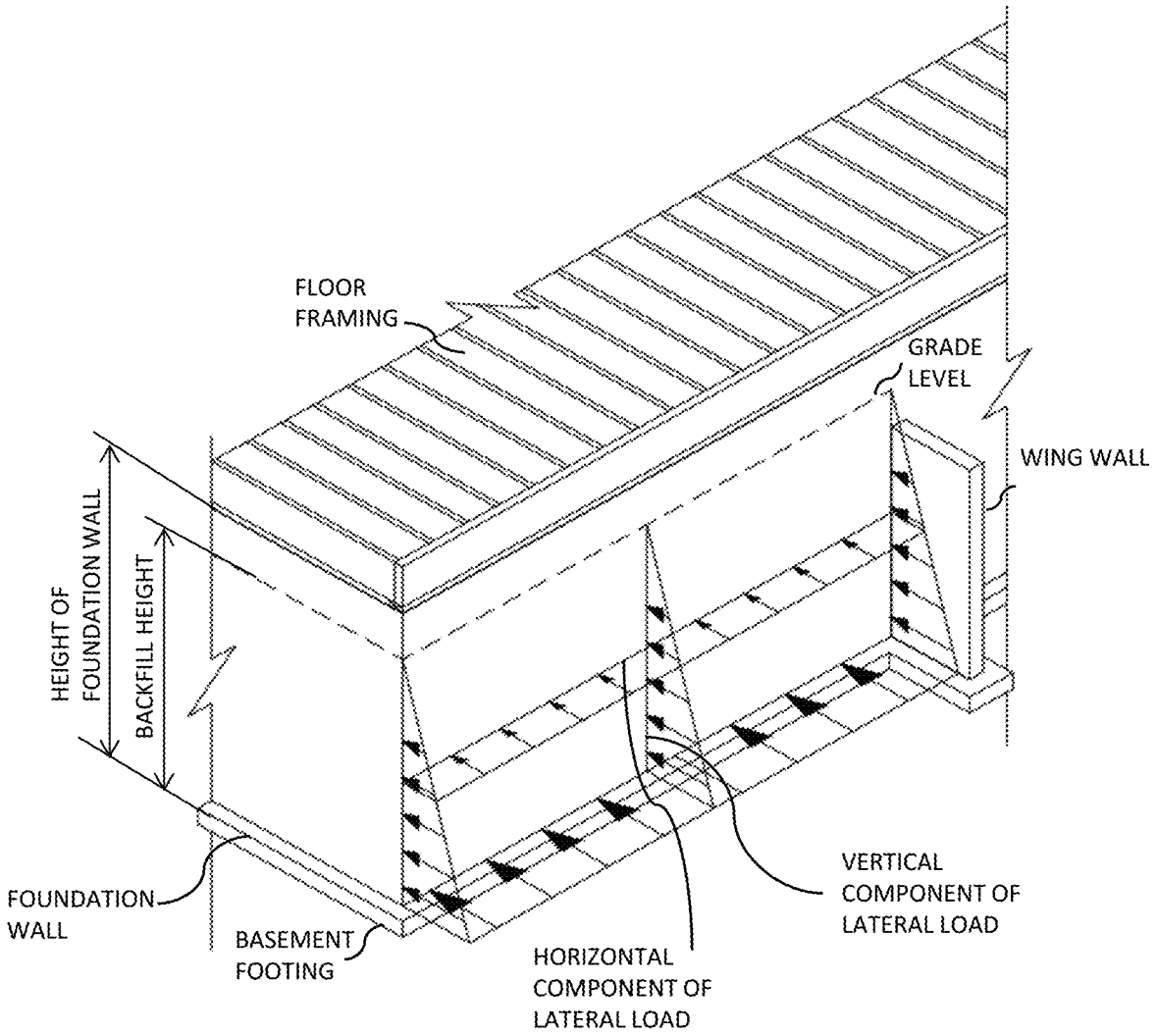
FIG. 10 depicts an isometric section view of a concrete foundation section with lateral stiffeners, in accordance an embodiment of the present invention.
Figure 11:
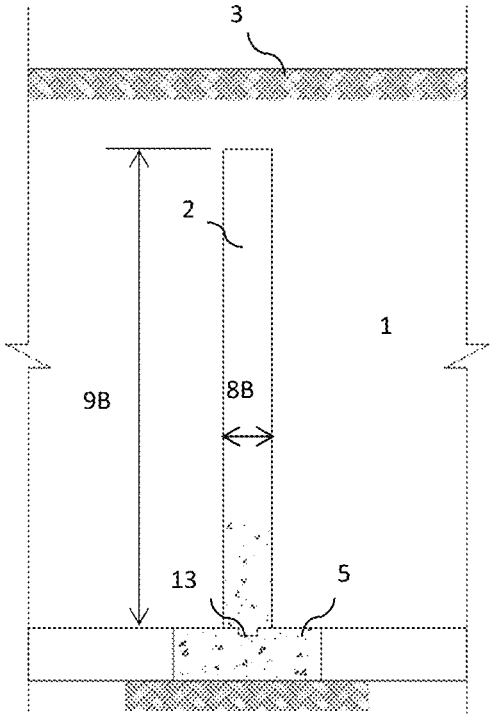
FIG. 11 depicts a front view of a section of the concrete foundation with lateral stiffener, in accordance with one embodiment of the present invention.
Figure 12:
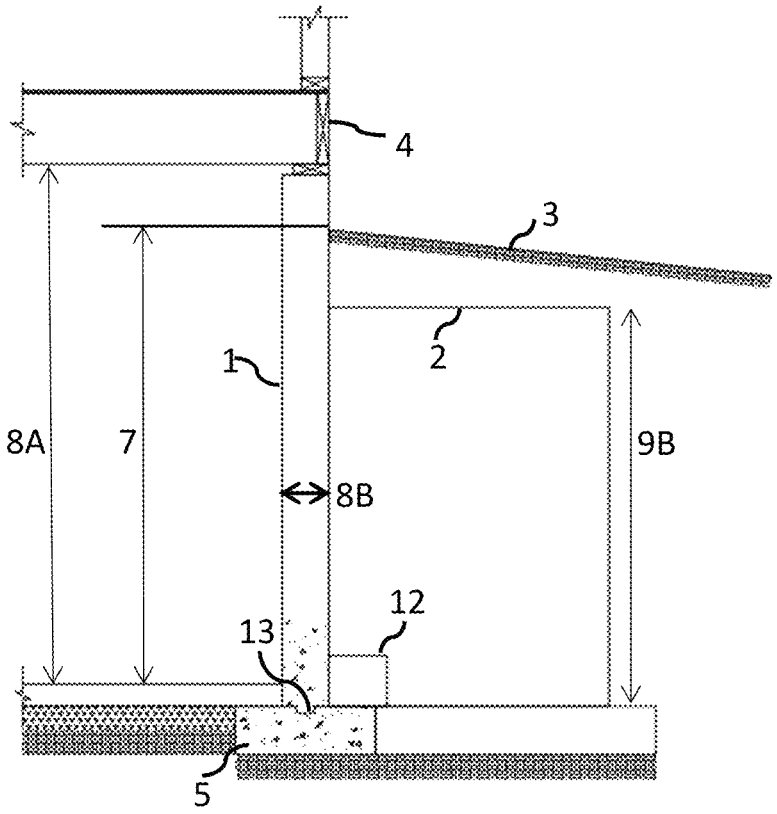
FIG. 12 depicts a side view of a section of the concrete foundation and lateral stiffener, in accordance with one embodiment of the present invention.
Figure 13:
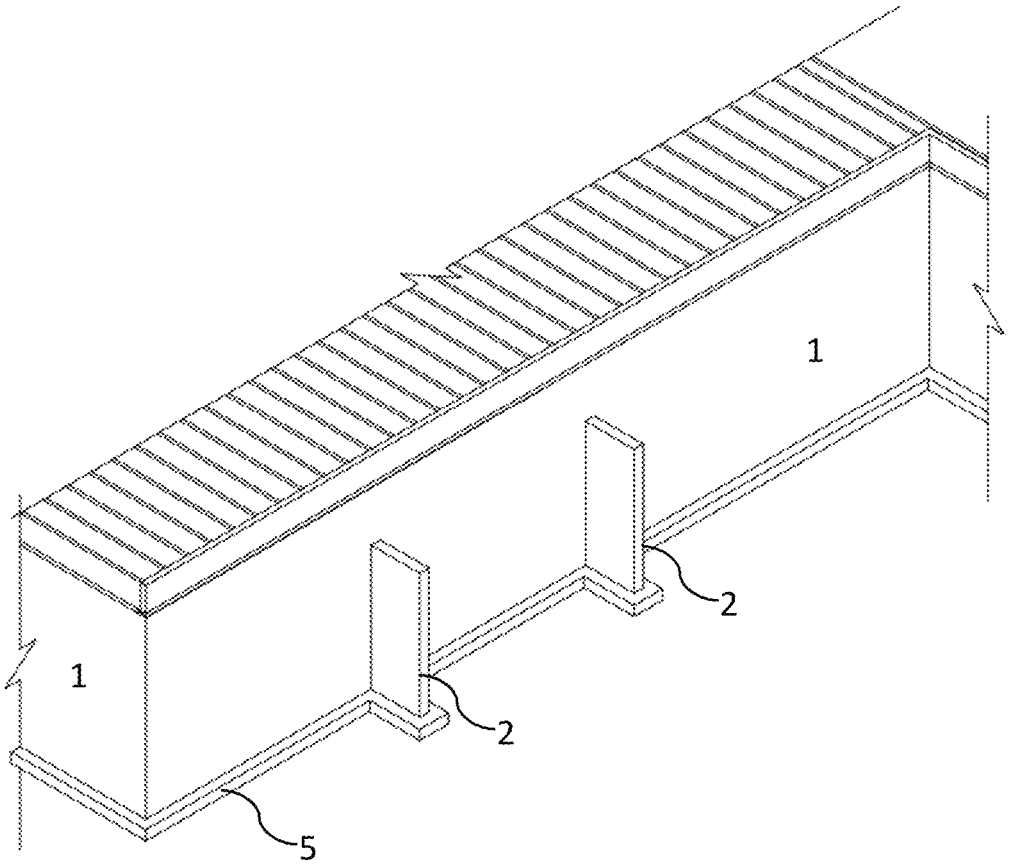
FIG. 13 depicts an isometric section view of the concrete foundation with lateral stiffeners, in accordance with one embodiment of the present invention.

Referring to FIGS. 9 and 12, the height 8A of the foundation wall 1, the grade level height 7 which matches the soil level 3. The foundation wall 1 has a thickness 8B and the height 8A, lateral stiffener 2 has a thickness 9A and a height 9B based on the grade level height 7. In the depicted embodiment, the height 9B of the lateral stiffener 2 is less than that of the grade level height 7. The footing 5 has a keyway 13 where the vertical foundation members are installed into the keyway 13. A drain tile 12 is also identified at the interface between the foundation wall 1 and the lateral stiffener 2. The lateral stiffeners 2 are not limited to rectangular or square but may be a variety of shapes based on the forces which are applied to the foundation wall 1.

Figure 14:
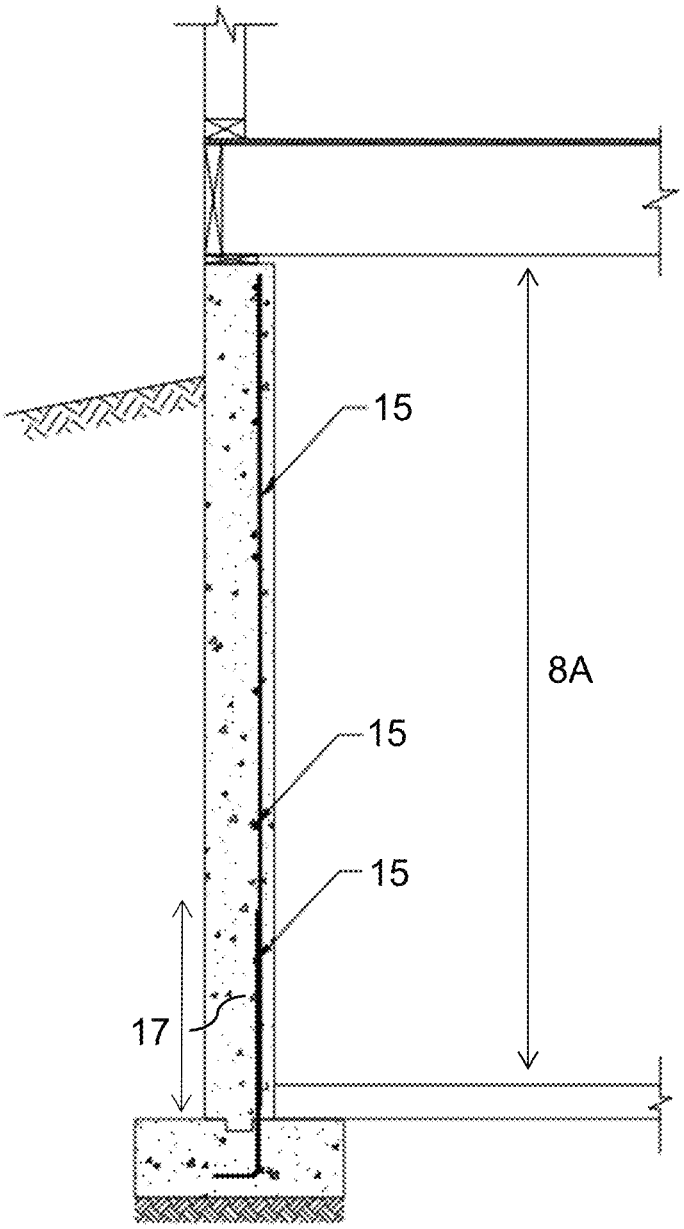
FIG. 14 depicts a side view of a section of the concrete foundation, in accordance with another embodiment of the present invention.
Figure 15:
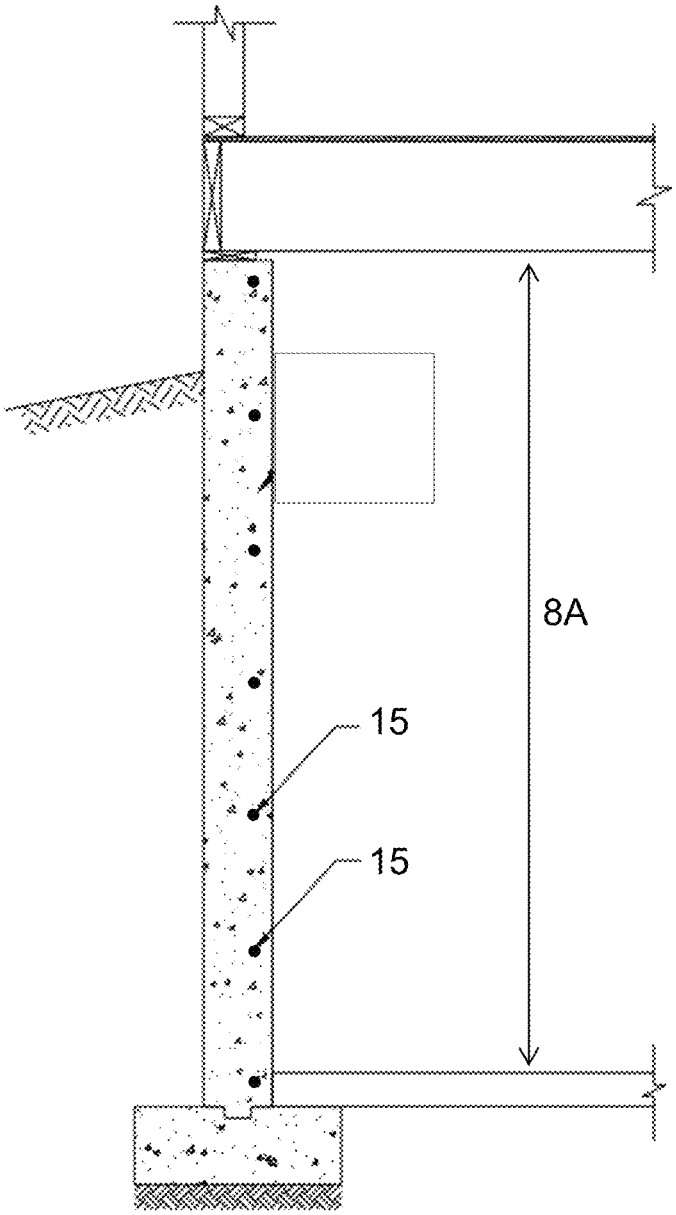
FIG. 15 depicts a side view of a section of the concrete foundation, in accordance with another embodiment of the present invention.

FIG. 14 depicts an embodiment, wherein the foundation wall 1 is reinforced with rebar pieces 15 and 16, wherein the rebar runs vertical through the foundation wall 1 and also through the foundation footer 5 wherein the rebar 16 is bent. The bent rebar has a height of 17 from the base, this height 17 is adjustable based on the desired strength In FIG. 15, the rebar is shown run horizontal through the foundation wall 1. The direction and orientation of the rebar 15 or the reinforcement member is based on the construction and the type of reinforcement member. In the depicted embodiment the rebar runs vertically and horizontally through the foundation wall 1. In additional embodiments, the rebar 15 and 16 or the reinforcement member can be run through the lateral stiffener 2 to provide additional strength to the foundation structure 100. In some embodiments, the rebar/reinforcement member is located near the exterior face of the foundation wall 1 for temperature purposes. This temperature reinforcement is located in higher stress (Zone) in horizontal direction at exterior face. This assists in reducing the tensile stresses in the concrete by eliminating the rebars stresses, In another embodiment, where the tensile stresses are within the allowable limits, temperature reinforcement members are provided for the foundation wall 1. In these instances, there is no need to reinforce the internal edge or side of the foundation wall 1.

The bending behavior of the wall foundation due to lateral load of backfilling, with or without lateral stiffener. The wall and the bottom flat foundation are the main components on which lateral load due to backfill is acting which cause the bending of the wall due to which the inner surface carries the tensile force and the deflected shape. With the addition of the lateral stiffener, which act as an extra support and minimize the deflection of the foundation wall due to lateral load.

The lateral stiffeners 2 are positioned below grade level and extend from the level of footings to about one foot below the grade level. Specific dimensions of the lateral stiffeners 2 will depend on the thickness and height of the foundation wall, length of a segment of the foundation wall, and also on the height and equivalent fluid weight of the backfill soil. Alternatively, if the dimensions of the foundation wall, lateral stiffeners 2 and footings are fixed, the length of a wall segment cannot exceed a certain magnitude.

The basic design is for plain concrete construction in which concrete is poured monolithically, and placement is not separated by construction or contraction joints. Only a minimum amount of horizontal temperature reinforcement is provided in both the foundation wall and the lateral stiffeners 2. The temperature reinforcement is located in higher stress zones and directions, and is a preferred location for the reinforcement using rebar or the like Another salient feature of the foundation wall system is the use of a relatively small size of footing 5 beneath the lateral stiffeners 2; in contrast, in the current foundation walls 1, there is a solid footing 5 extending between the lateral stiffeners 2 as a base slab. The width of footing 5 below the lateral stiffeners 2 can be the same as the width of footing 5 below the foundation wall. In other words, the foundation wall and the lateral stiffeners 2 can be constructed over a continuous strip footing 5 of uniform width.

The introduction of lateral stiffeners 2 ensures that two-way bending takes place in each segment of the foundation wall between two lateral stiffeners 2, or between a lateral stiffener and a cross wall. The design begins with tentative dimensions of the foundation wall segment, lateral stiffeners 2 and footing 5. Each foundation wall segment is analyzed separately assuming it to be free at the top, hinged at the bottom, and fixed at the two vertical sides. Analysis of the foundation wall system is then carried out for structural adequacy and stability.

Each foundation wall segment is subjected to a negative bending moment with tension on the inner face. The horizontal reactions of the wall segment are transmitted to the lateral stiffeners 2. In the simplest form, each vertical strip and each horizontal strip of the wall segment is analyzed as a beam subjected to uniform horizontal pressure. For structural adequacy, check is done to ensure that the tensile stress due to bending in any vertical or horizontal strip does not exceed the allowable limit for plain concrete. This allowable limit depends on the compressive strength of the concrete. In addition, check is done for the direct tensile stress acting at the joints where the lateral stiffeners 2 are connected to the foundation wall segment.

The stability of the foundation wall system against overturning is provided by the lateral stiffeners 2. As each lateral stiffener is made integral with the foundation wall, it acts as a T-beam with a flange equal to the center to center distance between two continuous, adjacent wall segments. The lateral pressure acting on the flange tends to overturn the lateral stiffener. This overturning moment is stabilized by the resisting moment on account of the self-weight of the lateral stiffener and the weight of the overlying soil over both the lateral stiffener 2 and the footing 5 beneath the lateral stiffener.

For example, an 8 inches thick poured concrete foundation wall of 8 feet height can withstand 7 feet height of soil backfill having 30 pcf equivalent fluid weight provided a first-floor deck supports the foundation wall at the top before backfilling of soil.

If the procedure of the invention is followed for the same wall dimensions and soil conditions, backfilling can be started before construction of a first floor deck just by providing lateral stiffeners 2 not farther than a center-to-center distance of 16 feet (10). Specifically, the required lateral stiffeners 2 will have a length of 4 feet, height of 6 feet and thickness of 8 inches. In addition, the footing 5 below the foundation wall and the lateral stiffeners 2 will have a width of 24 inches and thickness same as main foundation wall. The above dimensions are for a compressive strength of concrete equal to 3000 psi. Calculations for arriving at the above dimensions are provided at the end of this detailed description. The height, depth, and thickness of the lateral stiffeners 2 may be adjusted based on the height of the foundation wall, the span of the foundation wall, the soil composition and the like. The shape and size of the lateral stiffeners 2 may also be adjusted based on these factors to provide the necessary strengthening of the foundation wall.

As the first step of construction of the foundation wall system, the soil subgrade is excavated and cut in the desired shape for the footing 5 below the foundation wall and lateral stiffeners 2. Concrete is then poured to form the footing 5, and a keyway is provided at the top of the footing 5. In addition, vertical reinforcement dowels are left protruding from the top of the footing 5. In the next step, formwork for the foundation wall and lateral stiffeners 2 is erected, and a minimum amount of temperature reinforcement is provided. Thereafter, concrete is poured in the formwork ensuring that the vertical reinforcing dowels extend inside the foundation wall and lateral stiffeners 2. Once the concrete has attained its required strength, the formwork is removed. The operation of backfilling can be started immediately after this step. The construction of a first floor deck follows after the completion of backfilling.

Sample input data for describing the steps for determination of the maximum allowable length of a foundation wall segment is as follows:

Depth of backfill (h)=7.0 ft

Equivalent fluid weight of soil (w)=45 pcf

Compressive strength of concrete (fc)=3000 psi

Height of foundation wall (H)=8.0 ft

Thickness of foundation wall (d)=8 in.

Length of a segment of foundation wall=L

Height of lateral stiffener (HW)=6 ft

Thickness of lateral stiffener law)=8 in.

Length of lateral stiffener (measured from the face of the foundation wall)=4 ft Same dimensions of footing 5 are provided below the 20 foundation wall and lateral stiffeners 2.

Width of footing=24 in.

Thickness of footing=8 in.

It should be noted that the first step is to fix tentative dimensions of the foundation wall, lateral stiffeners 2 and footing 5*s*.

As the grade level is 1 foot below the top of the foundation wall, the actual loading on the foundation wall is changed to get an equivalent loading extending from the top of the foundation wall. This new equivalent fluid weight is represented by W'

$$\frac{W' \times h^2}{2} = \frac{W \times h^2}{2}$$

$$W' = \frac{W \times h^2}{H^2}$$

$$W' = 34.5 \text{ pcf}$$

Now that the dimensions of the foundation wall, lateral stiffeners 2 and footing 5*s* have been fixed, the next step is to determine the maximum distance which can be allowed between two lateral stiffeners 2 which is the same as the maximum permissible length of a foundation wall segment.

Let L=Maximum length of the foundation wall segment.

Assume initially a ratio of L/H equal to 2

$$\text{For } \frac{L}{H} = 2,\ L = 2 \times 8 = 16 \text{ ft}$$

Check for Bending Tensile Stress

For a vertical beam of 1 foot width, $$\text{maximum moment, } M_Y = \text{Moment coefficient} \times W' \times H^3$$

$$= 0.042 \times 34.5 \times 8^3$$

$$= 741.8 \text{ lb-ft}$$

$$= 8902 \text{ lb-in}$$

$$\text{Factored Moment, } M_{yu} = 1.6 \times 8902$$

$$= 14244 \text{ lb-in}$$

Similarly, for a horizontal beam of 1 foot width, $$\text{Maximum moment, } M_h = \text{Moment coefficient} \times W' \times H^3$$
$$= 0.059 \times 34.5 \times 8^3$$
$$= 1042 \text{ lb-ft}$$
$$= 12506 \text{ lb-in}$$
$$\text{Factored Moment, } M_{hu} = 1.6 \times 12506$$
$$= 20010 \text{ lb-in}$$

As per ACI 318 (Building Code Requirements for Structural Concrete), allowable tensile stress, $$f_a = 5 \times \phi \times \sqrt{f'c} = 5 \times 0.65 \times \sqrt{3000} = 178 \text{ psi}$$

Maximum tensile stress in the vertical beam, $$f_{vt} = \frac{M_{vu}}{b \times d^2/6} = 111 \text{ psi} < f_a = 178 \text{ psi}$$

Maximum tensile stress in the horizontal beam, $$fht = \frac{M_{hu}}{b \times d^2/6} = 156 \text{ psi} < f_a = 178 \text{ psi } (OK)$$

Check for Bending Tensile Stress

Overturning moment acting on the wall about the bottom of footing $$5 = 8300 \times \frac{h}{8} = 8300 \times \frac{7}{3} = 19366 \text{ lb-ft}$$

Width of footing 5 below lateral stiffener=8+8+8

=24 in

=2 ft

Assuming 130 pcf as combined density of concrete and soil, weight of soil and concrete over footing 5 that contributes to the stability of the lateral stiffener 2:

$$= (\text{Width of footing}) \times h \times (\text{Length of lateral stiffener}) +$$
$$(\text{Projection of footing beyond face of lateral stiffener}) \times 130$$
$$= 2 \times 7 \times (4 + 0.667) \times 130 = 8493 \text{ lb}$$
$$\text{Resulting Moment} = 8493 \times 4.667/2$$
$$= 19820 \text{ lb} = \text{ft} > 19366 \text{ ft-lb } (OK)$$

As the tentative dimensions have been proved to be satisfactory with respect to structural adequacy for each element as well as for overall stability, the design of the foundation wall system is adequate. Provide lateral stiffeners 2 so that the length of each segment of the foundation wall is equal to 16 feet.

If any of the above checks is not satisfactory, the design can be revised either by decreasing the length of the foundation wall segment, or by increasing the length of the lateral stiffener, or by increasing the width of the footing 5.

Typically, for equivalent fluid weight of soil ranging from 45 pcf to 60 pcf, the lateral stiffeners 2 are of 8 to 12 inches thickness, and they extend perpendicularly from the exterior surface of the foundation wall by 3 to 5 feet.

The footing 5*s* below the lateral stiffeners 2 can have a width of 24 to 30 inches and a thickness of 8 to 12 inches. By adopting any combination of dimensions of lateral stiffeners 2 and footing 5*s* from the above dimension ranges, the maximum allowable length of a wall segment for any foundation wall dimensions can be determined along the lines elaborated above.

While specific dimensions and configurations have been set forth for the purpose of describing the novel features of the invention, it should be recognized that these specifics can be varied by relying on the technology as taught without departing from the principles of the invention.

Present invention: should not be taken as an absolute indication that the subject matter described by the term "present invention" is covered by either the claims as they are filed, or by the claims that may eventually issue after patent prosecution; while the term "present invention" is used to help the reader to get a general feel for which disclosures herein that are believed as maybe being new, this understanding, as indicated by use of the term "present invention," is tentative and provisional and subject to change over the course of patent prosecution as relevant information is developed and as the claims are potentially amended.

The foregoing descriptions of various embodiments have been presented only for purposes of illustration and description. They are not intended to be exhaustive or to limit the present invention to the forms disclosed. Accordingly, many modifications and variations of the present invention are possible in light of the above teachings will be apparent to practitioners skilled in the art. Additionally, the above disclosure is not intended to limit the present invention. In the specification and claims the term "comprising" shall be understood to have a broad meaning similar to the term "including" and will be understood to imply the inclusion of a stated integer or step or group of integers or steps but not the exclusion of any other integer or step or group of integers or steps. This definition also applies to variations on the term "comprising" such as "comprise" and "comprises".

Although various representative embodiments of this invention have been described above with a certain degree of particularity, those skilled in the art could make numerous alterations to the disclosed embodiments without departing from the spirit or scope of the inventive subject matter set forth in the specification and claims. Joinder references (e.g. attached, adhered, joined) are to be construed broadly and may include intermediate members between a connection of elements and relative movement between elements. As such, joinder references do not necessarily infer that two elements are directly connected and in fixed relation to each other. Moreover, network connection references are to be construed broadly and may include intermediate members or devices between network connections of elements. As such, network connection references do not necessarily infer that two elements are in direct communication with each other. In some instances, in methodologies directly or indirectly set forth herein, various steps and operations are described in one possible order of operation, but those skilled in the art will recognize that steps and operations may be rearranged, replaced or eliminated without necessarily departing from the spirit and scope of the present invention. It is intended that all matter contained in the above description or shown in the accompanying drawings shall be interpreted as illustrative only and not limiting. Changes in detail or structure may be made without departing from the spirit of the invention as defined in the appended claims.

Although the present invention has been described with reference to the embodiments outlined above, various alternatives, modifications, variations, improvements and/or substantial equivalents, whether known or that are or may be presently foreseen, may become apparent to those having at least ordinary skill in the art. Listing the steps of a method in a certain order does not constitute any limitation on the order of the steps of the method. Accordingly, the embodiments of the invention set forth above are intended to be illustrative, not limiting. Persons skilled in the art will recognize that changes may be made in form and detail without departing from the spirit and scope of the invention. Therefore, the invention is intended to embrace all known or earlier developed alternatives, modifications, variations, improvements and/or substantial equivalents.

While this invention has been described in conjunction with the specific embodiments outlined above, it is evident that many alternatives, modifications and variations will be apparent to those skilled in the art. Accordingly, the preferred embodiments of the invention, as set forth above, are intended to be illustrative, not limiting. Various changes may be made without departing from the spirit and scope of this invention.

What is claimed is:

1. A foundation wall system comprising:

a foundation wall of a known height, thickness, and length and wherein a first end of the foundation wall has an extension protruding outward a predetermined length, wherein the foundation wall is reinforced with a plurality of reinforcement members;

a foundation base having a recessed groove of a predetermined depth along a centerline of the foundation base, wherein the foundation wall is situated on the foundation base by inserting the extension into the groove, and the foundation base has extensions along predetermined portions of the foundation base, wherein the foundation base has a uniform width and thickness;

a plurality of lateral stiffeners structures integrated into the foundation wall at predetermined location along the length of the foundation wall, wherein the lateral stiffeners are sized to fit on the extensions of the foundation base, and wherein the at least one of the lateral stiffeners are reinforced with a reinforcement member and each of the lateral stiffeners has a uniform horizontal cross section, and not extending above a top edge of the foundation wall; and a drain tile, wherein the drain tile interfaces with an exterior surface of the foundation wall and the lateral stiffeners at the foundation base.

2. The foundation wall system of claim 1, wherein the lateral stiffeners have a predetermined shape based on the height of the foundation wall and a location of integration into the foundation wall.

3. The foundation wall system of claim 1, wherein the lateral stiffeners height is below a grade level.

4. The foundation wall system of claim 1, wherein the lateral stiffeners interface with the foundation wall at substantially right angles.

* * * * *